US005256078A

United States Patent [19]

Lwee et al.

[11] Patent Number: 5,256,078

[45] Date of Patent: Oct. 26, 1993

[54] ELECTRICAL SOCKET

[75] Inventors: Nai H. Lwee, Fremont, Calif.; David J. Dutkowsky, Tokyo, Japan

[73] Assignee: E. I. Du Pont de Nemours and Company, Wilmington, Del.

[21] Appl. No.: 957,306

[22] Filed: Oct. 5, 1992

[30] Foreign Application Priority Data

Oct. 4, 1991 [JP] Japan ..... 3-283720

[51] Int. Cl.[5] ..... H01R 13/00

[52] U.S. Cl. ..... 439/326

[58] Field of Search ..... 439/296, 326-328, 439/629-637

[56] References Cited

U.S. PATENT DOCUMENTS 5,112,242 5/1992 Choy et al. ..... 439/326

5,151,046 9/1992 Korsunky et al. ..... 439/326

*Primary Examiner*—Joseph H. McGlynn

*Attorney, Agent, or Firm*—Woodcock Washburn Kurtz Machiewicz & Norris

[57] ABSTRACT

A socket has a housing equipped with an elastic metal sheet between both ends thereof. The metal sheet is provided integral with a mount leg portion for mounting the housing on a mother board, a hook for engaging a corresponding engaging hole in a daughter board, and a leaf spring for elastically pushing up the daughter board in a manner to engage the hook. The daughter board inserted in a recess of the housing is pushed up by the leaf spring whereby the engagement of the daughter board and hook is ensured.

7 Claims, 8 Drawing Sheets

ELECTRICAL SOCKET

BACKGROUND OF THE INVENTION

1.Field of the Invention

The present invention relates to a socket for electrically and mechanically connecting together first and second substrates.

2. Description of the Related Art

A daughter board, such as a single-in-line memory module (hereinafter referred to as SIMM), is electrically connected by a socket to a printed circuit board as a mother board.

The socket has a socket body molded of plastic, etc. The socket body has a groove in which a contact array area of a base end portion of the daughter board is inserted.

Upon the connection of the daughter board to the mother board, the base end portion of the daughter board is inserted into the groove of the socket body in a direction oblique to the surface of the mother board. Then, the daughter board is rotated to a position vertical to the surface of the mother board. The contact array area of the base end portion of the daughter board thus held vertical is placed in electrical contact with the contacts of the socket under the spring action of the contacts of the socket.

In order to fix the daughter board at a vertical position, a pair of columns are provided one at each end portion of the socket body in a manner to be formed integral with the socket body. The column has a boss and the daughter board is fixedly held at the vertical position with the boss of the column engaging the engaging hole.

When, however, the attachment and detachment of the daughter board are repeated a greater number of times, the column integral with the socket body is flexed beyond an elastic deformation limit due to a fatigue involved, causing a poor engagement between the boss of the column and the engaging hole of the daughter board. As a result, a defective electrical connection is liable to be produced between the contact array area of the daughter board and the contacts of the socket.

In order to overcome this disadvantage, it has been conceived that a column-reinforcing member is molded integral with the socket body to prevent a column deformation. According to the invention, the configuration of the socket body becomes complicated, failing to satisfy the basic need to simplify the manufacturing steps of the socket body and to reduce the manufacturing cost.

SUMMARY OF THE INVENTION

It is accordingly the object of the invention provide an electrical socket which can ensure a positive engagement with an inserted substrate without complicating the configuration of a socket body.

According to the present invention, there is provided an electrical socket for connecting a first substrate which has engaging areas to a second substrate, which comprises:

an elongated housing of an elastic insulating material, mountable on the second substrate, the housing having a recess extending from proximate one end to proximate the other end thereof and is dimensioned to receive the first substrate therein and the first substrate to be rotated relative to the second substrate and engaging members extending along the first substrate, at the ends of the housing, the engaging members engaging the engaging areas of the first substrate so that the first substrate is held at the predetermined rotation position;

a plurality of contacts positioned in the recess for electrically and mechanically connecting the first substrate to the second substrate; and elastic means positioned in the recess and, with the engaging areas of the first substrate engaging the engaging members, elastically pushing the first substrate in a direction in which their engagement is urged.

There is also provided an electrical socket for connecting a first substrate which has engaging areas to a second substrate, which comprises:

an elongated housing of an elastic insulating material, mountable on the second substrate, the housing having a recess extending from proximate one end to proximate the other end thereof and is dimensioned to receive the first substrate therein and the first substrate to be rotated relative to the second substrate;

a plurality of contacts positioned in the recess for electrically and mechanically connecting the first substrate to the second substrate;

elastic means positioned on at each end of the housing, the elastic means having an engaging portion which being projected from the housing and engaging the engaging areas of the first substrate to hold the first substrate at a predetermined rotation position, and a spring portion which being provided in the recess and, with the engaging areas of the first substrate engaging the engaging portion, elastically pushing the first substrate in a direction in which their engagement is urged.

In the socket as claimed in claim 1, with the engaging areas of the first substrate engaging the engaging members of the housing, the elastic means presses the first substrate in a direction in which their engagement is urged. As a result, a positive engagement is secured between the first substrate and the housing.

In the socket as claimed in claim 3, the elastic means is provided integral with the engaging portion and spring portion and performs all the operations of supporting the first substrate, engaging the first substrate and urging an engagement between the first substrate and the engaging portion. This simplifying the configuration of the housing.

DETAILED DESCRIPTION OF THE PREFERRED EMBODIMENTS

Figure 1:
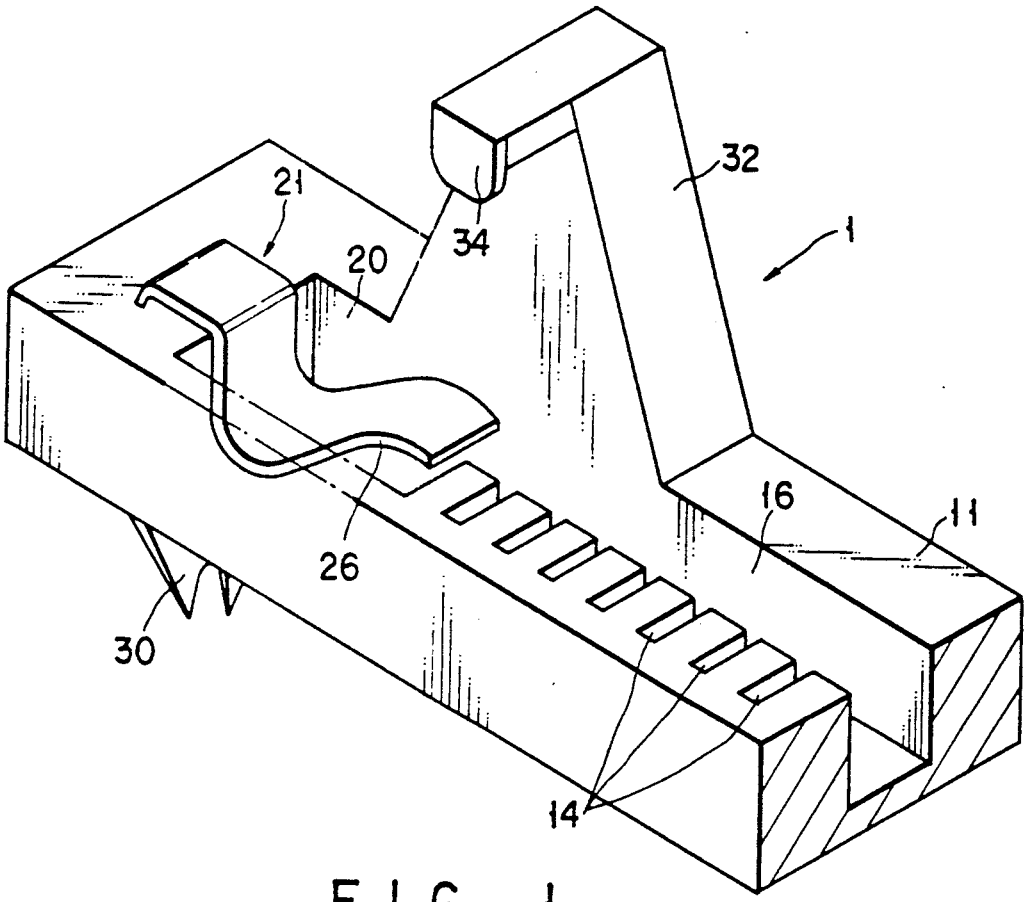
FIG. 1 is a perspective view showing a portion of a socket according to a first embodiment of the invention.
Figure 2:
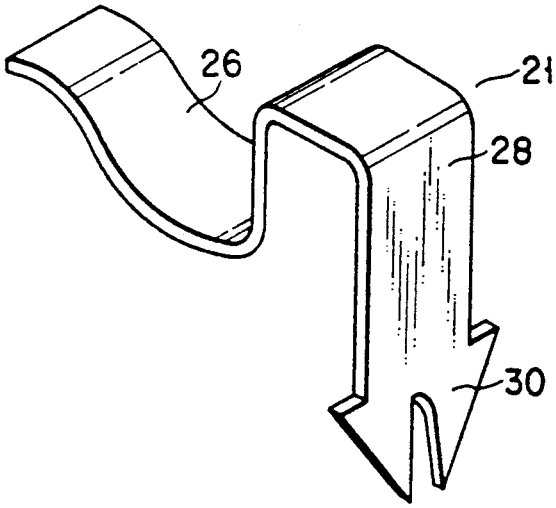
FIG. 2 is a perspective view showing a spring member in FIG. 1.

FIGS. 1 and 2 show an electrical socket according to a first embodiment of the invention. The socket 1 has a socket body (housing) 11 molded of an elastic, insulating resin material, such as plastics. The socket 1 has a mirror image-like configuration, only the left section of which is shown for brevity's sake.

In FIG. 1, the socket body 11 has an array of recesses 14 between both end portions in its longitudinal direction. A longitudinal recess 16 is provided between both end portions of the socket body 11 such that it extends in a direction intersecting the recesses 14. A contact 18 (not shown in FIG. 1) as set out below is to be inserted into the respective recess 14. A spring accommodating sections 20 are provided at the end portions of the longitudinal recess 16.

A leaf spring member 21 is provided with its free end portion 26 located in the spring accommodating section 20. The leaf spring member 21 is made of an elastic material, such as phosphor bronze or stainless steel, and bent to a predetermined configuration. The spring member comprises the free end section 26 constituting a forward end section, a fixing section 28 constituting an intermediate section, and a mount leg section 30 constituting a base end section. The free end section 26 is of such a nature that it elastically acts against a depression force which is applied from below. The fixing section 28 of the spring member 21 is buried in the socket body 11 at and near the spring accommodating section 20 and the mount leg section 30 of the spring member is projected, as a wedge, below the socket body 11.

A column 32 is provided on one side-section side of the socket body 11 and has an engaging boss 34 provided at an upper end portion and projected from an inner side of the column 32.

Figure 3:
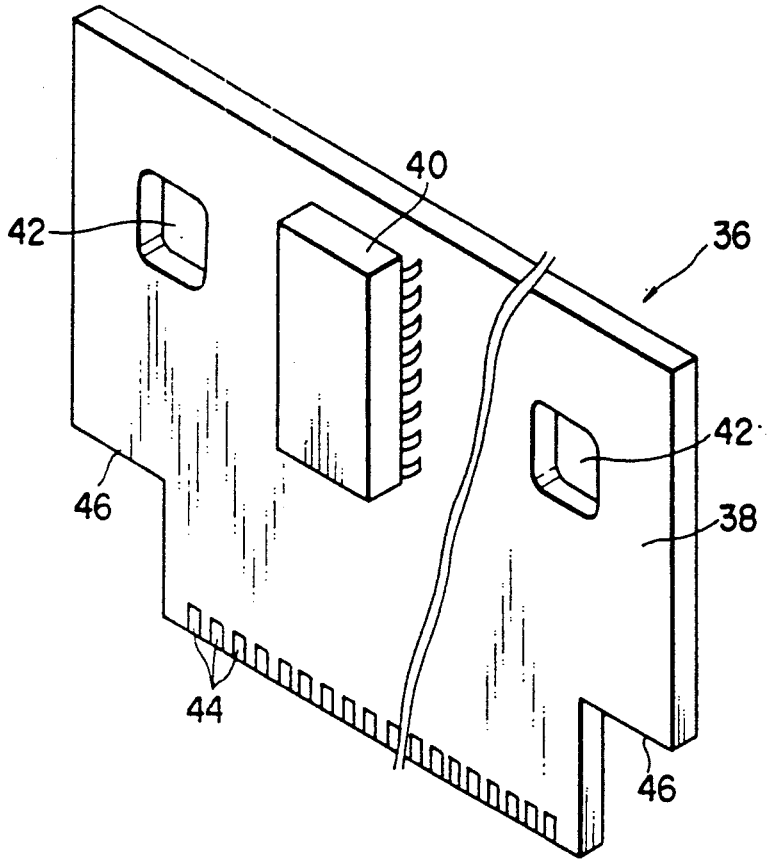
FIG. 3 is a perspective view showing a single-in-line memory module (SIMM) to be connected to a socket of the invention.

FIG. 3 shows a single in-line memory module (hereinafter referred to as an SIMM) 36 to be mounted in the socket 1. SIMM 36 is comprised of a memory circuit board 38 called a daughter board. The circuit board 38 has a plurality of electronic component parts 40 mounted thereon and a pair of openings 42 provided one at an area near each side portion. The circuit board 38 is held relative to the socket 1 through each hole 42 in cooperation with the engaging boss 34. An edge contact 44 is provided at a base end portion of the circuit board 38 such that it is arranged, as an array, in a direction of the width of the circuit board 38. Further, a pair of shoulders 46 are provided one at each end portion of the "edge contact" array area by rectangularly cutting off each lower corner section of the base end portion of the circuit board 38.

Figure 4:
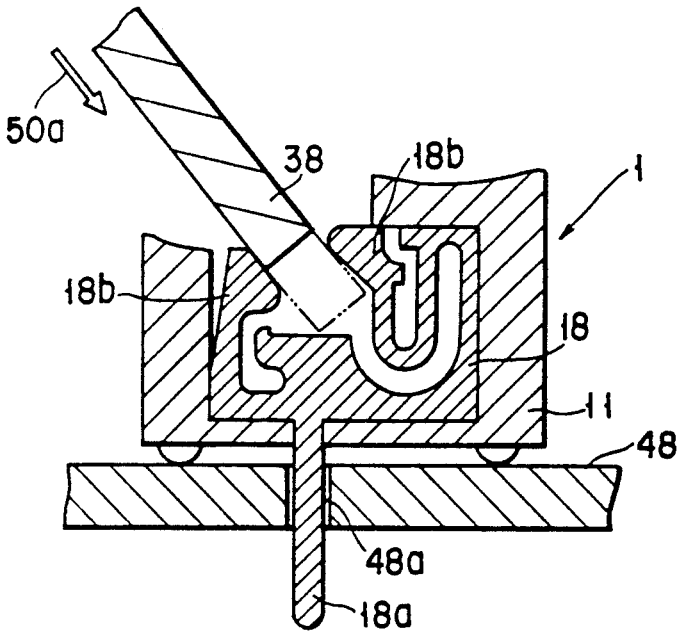
FIG. 4 shows a contact for use in the socket of the invention.

FIG. 4 shows a contact 18 inserted into each recess 14 of the socket 1. The contact 18 is known as a conventional one for SIMM. A lower end section 18*a* of the contact 18 is mechanically and electrically connected to a printed circuit board 48 by, for example, inserting the lower end section 18*a* of the contact 18 through a corresponding through-hole 48*a* of the printed circuit board 48. Here, the printed circuit board 48 is one called a mother board where, for example, a CPU chip, not shown, is mounted.

The upper end area 18*b* of the contact 18 rotatably holds the base end portion of the daughter board 38 in a sandwiched relation and holds it in mechanical and electrical contact with the edge contact 44. The contact 18 is not restricted to the one shown in FIG. 4 and can be properly selected from those known contacts for SIMMs.

The operation of the socket 1 will be explained below with reference to FIG. 5.

The socket 1 is mounted on the mother board 48 by inserting the mount leg section 30 of the spring member 21 through the mother board 48. The daughter board 38 for SIMMs 36 is held upright relative to the mother board 48 as indicated by the dash-dot lines in FIG. 5 by obliquely inserting the daughter board 38 into the longitudinal groove 16 of the socket 1 from a direction 50*a* as indicated by an arrow 50*a* in FIG. 5 and rotating it in a direction as indicated by an arrow 50*b* in FIG. 5. In this state, the engaging boss 34 of the column 32 is fitted into the opening 42 from the rear surface side of the daughter board 38, noting that the longitudinal size $D_1$ of the opening 42 is made somewhat greater than the longitudinal size $D_2$ of the engaging boss 34.

With the engaging boss 34 fitted in the opening 42 and the daughter board 38 held upright in that position, the free end portion 26 of the spring member 21 in the spring accommodating section 20 abuts against the lower edge of the shoulder 46 of the daughter board 38. The daughter 38 is upwardly urged (in a direction indicated by an arrow 50*c* in FIG. 5) by a spring force of the free end portion 26 of the spring member 21. At that time, the daughter board 38 can be upwardly moved because the longitudinal size $D_1$ of the opening 42 is made somewhat greater than the longitudinal size $D_2$ of the engaging boss 34. As a result, a lower edge 42*a* of the opening 42 is depressed by a lower end 34*a* of the engaging boss 34 so that both are brought into urging and firm engagement with each other.

According to the present invention, the use of the spring member 21 can achieve a firm engagement between the engaging boss 34 and the opening 42 even if the column 32 somewhat fatigues. For this reason, the socket body 11 need not be formed integral with a reinforcing member for the column 32 and it is easier to mold.

It is to be noted that the spring member 21 is not necessarily required to have the mount leg section 30. In the case where the spring member 21 has no mount leg section 30, it is only necessary that a proper post for mounting the socket body 11 on the mother board 48 be molded integral with the socket body 11. In order to simplify the shape of the socket body, it is preferred that the spring member 21 have the mount leg section 30.

Figure 6:
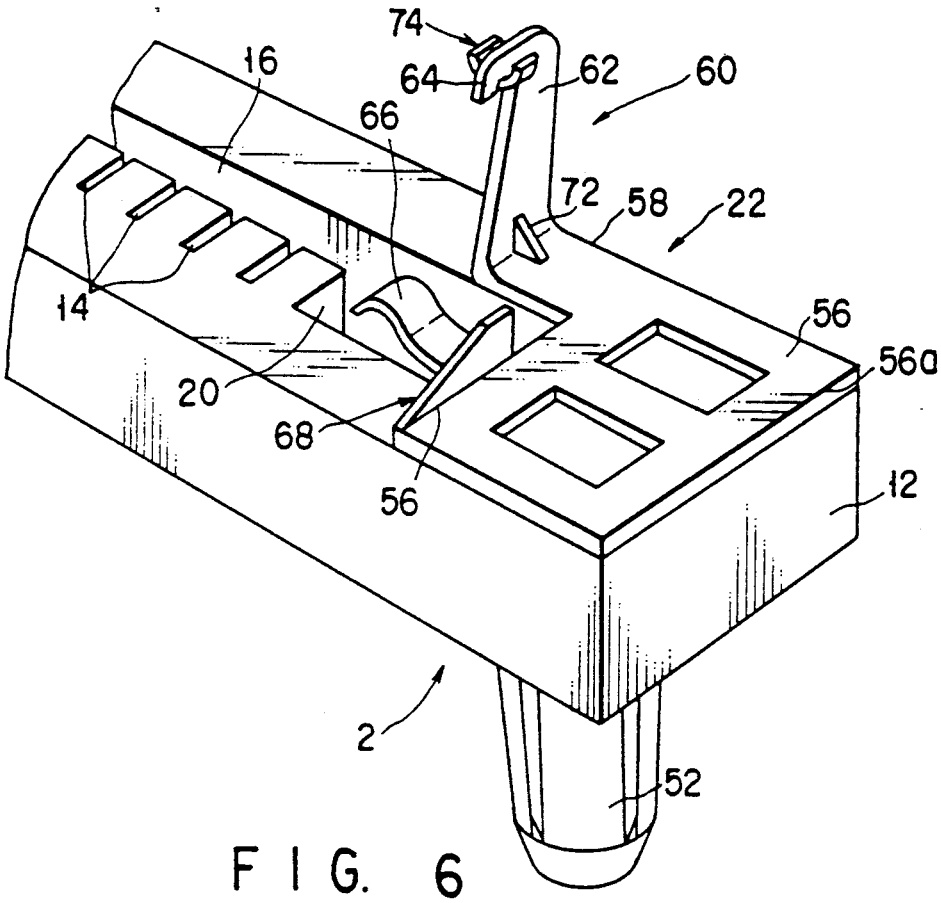
FIG. 6 is a perspective view showing a portion of a socket according to a second embodiment of the invention.
Figure 7:
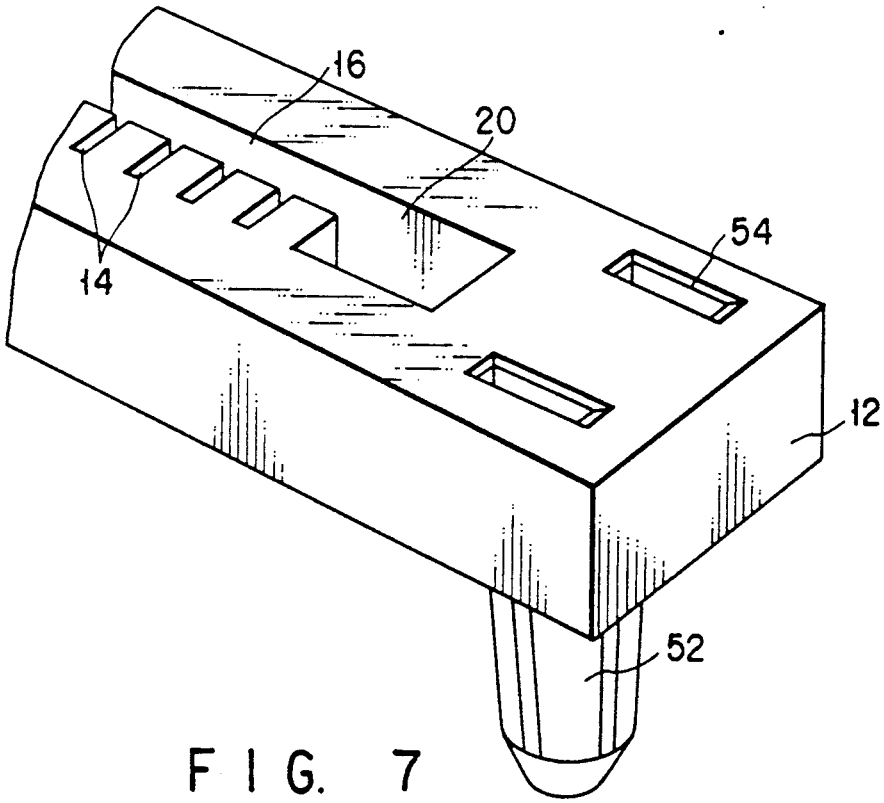
FIG. 7 is a perspective view showing a portion of a socket body in FIG. 6.
Figure 8:
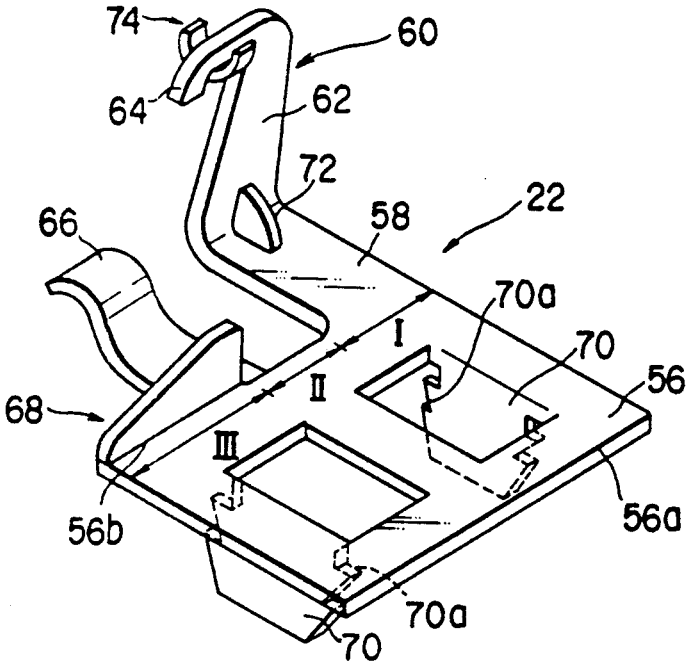
FIG. 8 is a perspective view showing an elastic member in FIG. 6.

FIGS. 6 to 8 show a second embodiment of the present invention. A socket according to the second embodiment of the present invention has a mirrow image-like configuration and only its right side section is shown for brevity's sake, In a socket 2 shown in FIGS. 6 and 7, recesses 14 in a socket body 12, longitudinal groove 6, spring accommodation section 20, and material of the socket body 12 are the same as those in the first embodiment of the present invention. Let it be assumed that the aforementioned contact, not shown in FIGS. 6 and 7, is located in the recess 14. The socket body 12 is different from the socket body 11 in the first embodiment in that it has neither the column 32 nor the engaging boss 34 and that a post 52 for mounting the socket body 12 on the mother board 48 is projected down from the lower surface of each end portion of the socket body 12.

Further, it is preferred that engaging holes 54 (see FIG. 7) for fixing an elastic member 22 as will be set out below be provided in the top surface portion of each end portion of the socket body 12.

As shown in FIG. 8 in particular, the elastic member 22 is integrally formed by basically bending an elastic material sheet, preferably phosphor bronze or other proper metals, and forming openings or holes in the elastic material sheet by a bending/cutting method. The elastic member 22 has a flat basic sheet 56. One end portion 56*a* of the flat basic sheet, that is, that portion of the flat basic sheet facing the end of the longitudinal groove 16, is divided along the edge of the basic sheet 56 into areas I, II and III.

Here, a flat arm 58 extends from the area I of the basic sheet 56. The forward end portion of the arm 58 is bent in a direction substantially vertical to a flat plane of the basic sheet 56 and arm 58 to provide a hook member 60. The hook member 60 has a column 62 upwardly extending, as an upright column, from the arm 58 and a hook 64 extending from the forward end of the column 62. The column 62 and hook 64 perform the same function as the column 32 and hook 64 in the first embodiment.

A leaf spring member 66 extends downwardly from the area II of the flat basic sheet 56 and performs a function corresponding to that of the free end portion 26 of the spring member 21 in the first embodiment.

It is preferred that the elastic member 22 integrally have a guide member 68 for guiding the daughter board 48 into the longitudinal groove 16 and a leg section 70 for fixing the elastic member 22 to the socket body 12.

The guide member 68 is so bent as to upwardly extend from the area III of the basic sheet 56 and to be inclined toward the other end 56 side of the basic sheet 56.

The leg sections 70 are provided as struck-out sections extending substantially vertically from the upper surface side to the rear surface side of the basic sheet 56. The leg sections 70 are fitted into engaging holes 54 in the socket body 12. In order to achieve a positive engagement of the leg section 70 with the engaging hole 54 of the socket body, a slippage stop or detent 70*a* is preferably provided on each side edge of, for example, the legs 70. In this connection it is to be noted that, in order to detachably mount the elastic member 22 on the socket body 12, the leg sections 70 of the elastic member 22 can be attached to, or detached from, the engaging holes 54 either manually or by a proper tool.

The integral elastic member 22 has, preferably as added members, a rib 72 for reinforcing the column 62 and pad 74 for assisting the hook 64. The added members are formed of the same material as the elastic material sheet of which the elastic member 22 is made.

The rib 72 is provided, by soldering, welding, etc. between the base end of the column 62 and the arm 58.

The pad 74 is so provided as to increase the thickness of the hook 64. Since the hook 64 is formed of a single sheet, there is a possibility that no positive engagement will be secured relative to the opening 42 of the daughter board in the light of the thickness with which the hook 64 is formed. The pad 74 has a configuration corresponding to that of the opening 42 of the daughter board and, in the example shown in FIG. 8, has a curved sheet-like configuration. The configuration of the pad 74 is not restricted to that shown in FIG. 8.

The basic sheet 56 of the elastic member 22 is fixed to a top surface area of the end portion of the socket body 12 by inserting the leg section 56 of the elastic member 22 into the engaging hole 54 of the socket body 12. In this state, the spring member 66 is held in the spring accommodating section 20 of the socket body 12.

Figure 5:
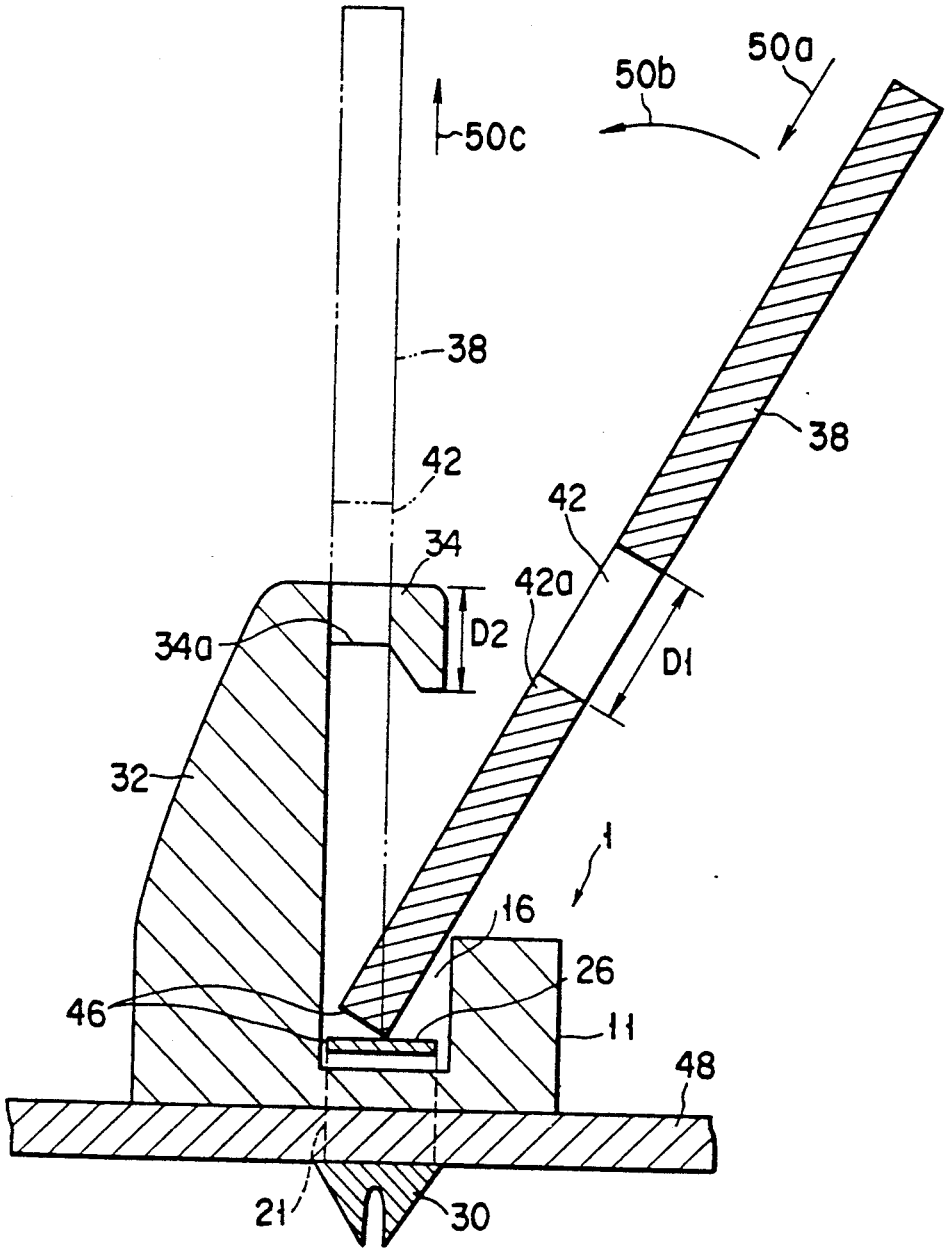
FIG. 5 is an explanatory view showing the operation of SIMM in the socket in FIG. 1.

The socket 2 is mounted on the mother board 48 (FIG. 5). When the daughter board 38 (FIGS. 3 and 5) is to be obliquely inserted into the socket 3, the respective side edges of the daughter 38 are slidably guided by the guide member 54 and the daughter board 38 can readily be inserted into the longitudinal groove 16. With the daughter board 38 rotated to an upright position, the pad-equipped hook 64 is fitted into the opening 42 of the daughter board 42 in the same way as explained in conjunction with the first embodiment with reference to FIG. 5, so that the engagement is placed in the urged state under the influence of the spring member.

Since, in the second embodiment, the elastic member 22 has the spring member 66 and hook member 60 as an integral unit, no particular means for supporting the daughter board 38 in an engaged relation is required on the socket body 12. Therefore, the socket body 12 has a simple configuration and is easier to mold. It is possible to obtain that hook member 60 of outstanding strength in comparison with the column 32 and engaging boss 34 made of a resin material in the first embodiment. Further, the rib 72 is attached to the elastic member 22 as a reinforcing member for the column 62 of the hook member 60, whereby it is possible to further improve the strength of the hook member 60.

Figure 9:
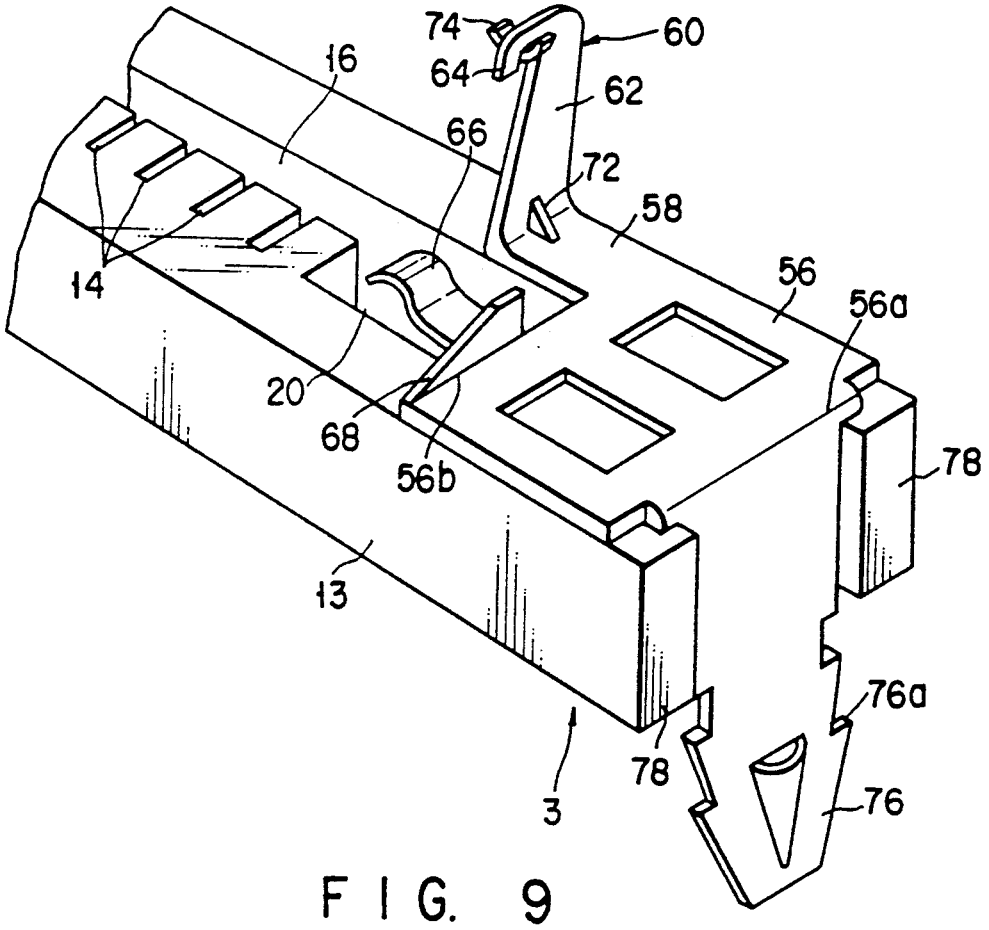
FIG. 9 is a perspective view showing a portion of a socket according to a third embodiment of the invention.
Figure 10:
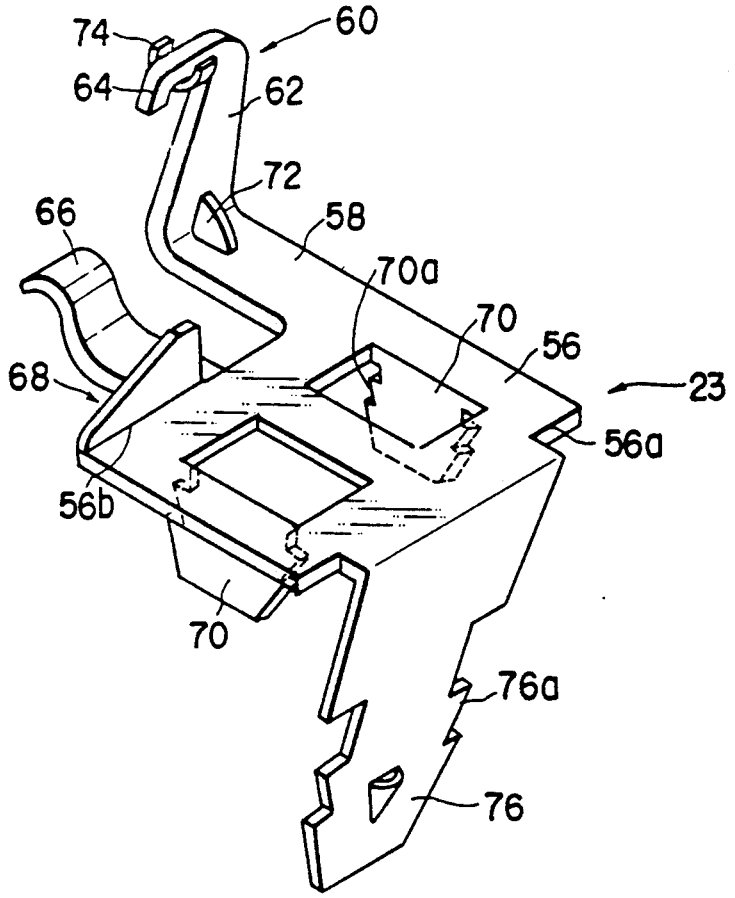
FIG. 10 is a perspective view showing an elastic member in FIG. 9.
Figure 11:
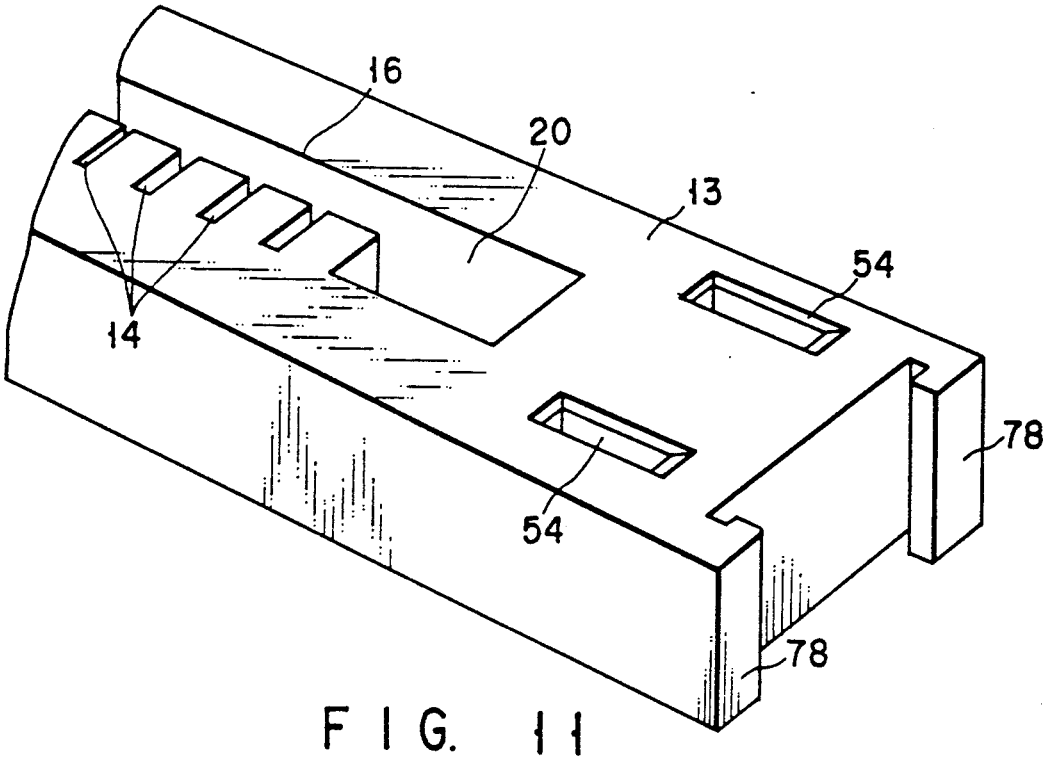
FIG. 11 is a perspective view showing a portion of a socket body in FIG. 1.

FIGS. 9 to 11 show a third embodiment of the present invention. In these Figures, the same reference numerals are employed to designate parts or elements corresponding to those shown in the first and second embodiments.

A socket 3 whose right-side section is shown in FIG. 9 has a socket body 13 and elastic member 23.

As shown in FIG. 10 in particular, the elastic member 23 further add a wedge-like mount leg section 76 to the elastic member 22 in the second embodiment so as to mount the socket body 13 on the mother board 48. The mount leg section 76 is so bent that it extends down from the other end edge side of a basic sheet 56, that is, that end edge side facing the end face of the socket body 13 and extends in a direction substantially vertical to the flat surface of the basic plate. It is desirable that a slippage stop or detent 76*a* be formed on both side edges of the mount leg section 76.

As shown in FIG. 11 in particular, a pair of guides 78 are integrally molded on each end face of the socket body 13 such that they extend in a direction of the height of the socket body 13. The mount leg section 76 is fixed to the end face of the socket body 13 by inserting the mount leg section 76 of the elastic member 23 between the paired guides 78. The socket body 13 is similar in its construction to the counterpart of the second embodiment except that it has the paired guides 78 and that it omits the post 52 in the second embodiment.

The socket 3 is mounted on the mother board 48 (FIG. 5) by mounting the mount leg section 76 of elastic member 23 in the mother board 48 in a wedged relation. Once the mount leg section 76 is so mounted in the mother board 48, the socket is firmly fixed to the mother board 48 in which case the socket 3 has a resistance to a stress on the socket 3 as caused upon the soldering of electronic parts to the mother board 48 and handling of the socket 3. The elastic member 23 is similar in its operation and advantages to the counterpart of the second embodiment except that it has the mount leg section 76.

The provision of the mount leg section 76 in the third embodiment obviates the necessity of providing the post 52 in the second embodiment which is required to mount the socket body 13 on the mother board 48. As a result, the socket body 13 has a substantially rectangular configuration and, therefore, easier to mold because of its simpler configuration.

Figure 12:
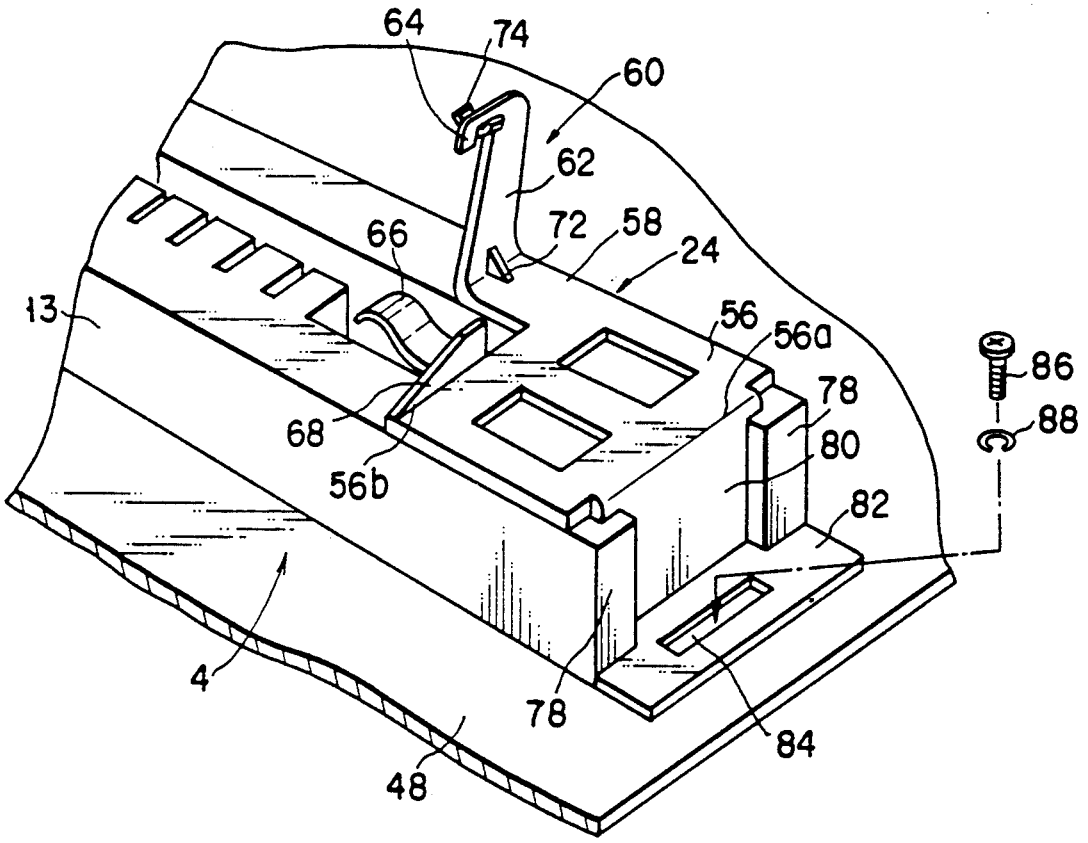
FIG. 12 is a perspective view showing a portion of a socket according to a fourth embodiment of the invention.
Figure 13:
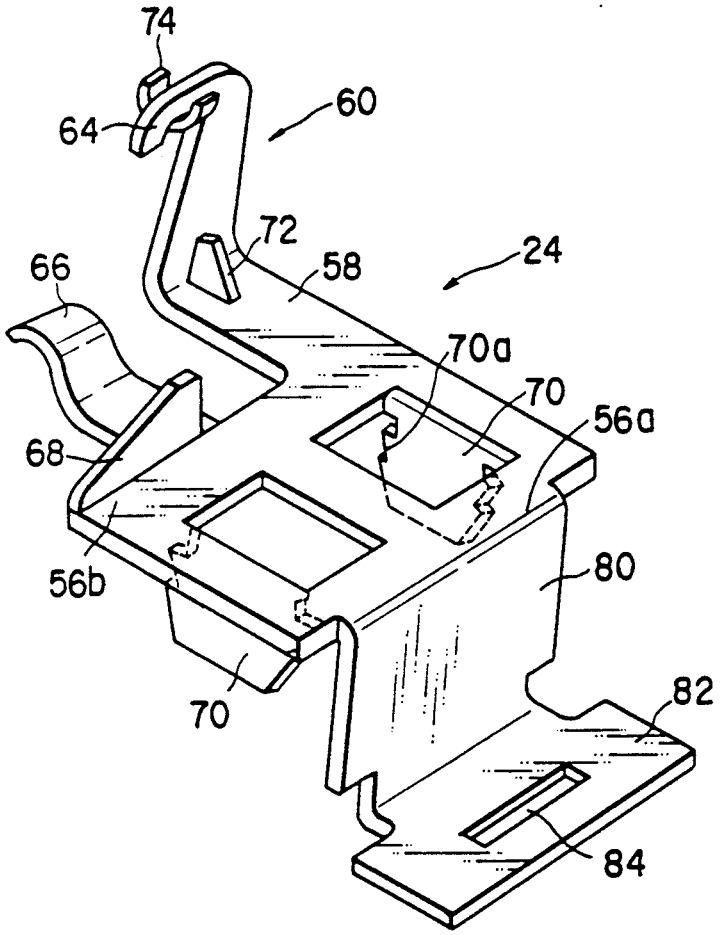
FIG. 13 is a perspective view showing an elastic member in FIG. 12.

FIGS. 11 to 13 show a fourth embodiment of the present invention. A socket 4 whose right-side portion is shown in FIG. 11 has a socket body 13 and elastic member 24. The socket body 13 is entirely the same as that of the third embodiment. The elastic member 24 is the same as the counterpart of the third embodiment except the configuration of the mount leg section 80. An explanation will be made below only about the difference relative to the third embodiment. The mount leg section 80 is substantially L-like in configuration, that is, is so bent that it extends in a substantially vertical direction from an end edge 56*b* of the base plate 56 with the forward end portion of the L-like mount leg section extending as a flat mount sheet portion 82 facing the surface of the mother board 48 in a parallel relation. The mount sheet portion 82 of the mount leg section 80 has an elongated hole 84 along a direction of the depth of the socket body 13. The mount leg section 80 of the elastic member 24 is fixed to the end surface of the socket body 13, as in the mount leg section 76 of the third embodiment, by inserting the mount leg section between the paired guides 78.

In the case where a socket 4 is to be mounted on the mother board 48, for example, a screw 86 is inserted via washer 88 and elongated hole 84 into a through hole (not shown) of the mother board 48 and threadably inserted into a nut, not shown, on the mother board side, so that the mount sheet portion 82 of the mount leg section 80 is fixed to the mother board 48. Since, in this case, the screw insertion hole 84 is elongated, the socket body 13 is easier to locate relative to the mother board 48 and hence the socket 3 is rigidly fixed to the mother board 48.

The socket of the present invention is not restricted to the aforementioned embodiment. Various changes or modifications of the present invention may be made without departing from the spirit and scope of the present invention. For example, the engaging area of the daughter board 38 may be not only the opening 42 but also a hook area, etc. Depending upon the configuration of the engaging area of the daughter board 38, both the column 32 in the first embodiment and the hook 60 in the second through fourth embodiments can be so designed as shown in the above Figures or designed to have other proper forms.

Although, in the aforementioned embodiment, the daughter board 38 provided on the socket is set upright relative to the mother board 48, it may take an inclined position relative to, for example, the mother board 48. Further, the daughter board 38 is not restricted to a direction in which it is upwardly urged in its engaged state and can be properly set to a proper direction depending upon the engaging manner of the daughter board 38, the attitude, etc., of the daughter board 38 mounted on the socket. It is possible to change the configuration and attitude assumed of the spring members 21 and 66.

What is claimed is:

1. An electrical socket for connecting a first substrate which has engaging areas to a second substrate, comprising:

an elongated housing of an elastic insulating material, mountable on the second substrate, the housing having a recess extending from proximate one end to proximate the other end thereof and is dimensioned to receive the first substrate therein and the first substrate to be rotated relative to the second substrate and engaging members extending along the first substrate, at the ends of the housing, the engaging members engaging the engaging areas of the first substrate so that the first substrate is held at the predetermined rotation position;

a plurality of contacts positioned in the recess for electrically and mechanically connecting the first substrate to the second substrate; and elastic means positioned in the recess and, with the engaging areas of the first substrate engaging the engaging members, elastically pushing the first substrate in a direction in which their engagement is urged.

2. The electrical socket according to claim 1, wherein said elastic means has a mounting portion for mounting the housing on the second substrate.

3. An electrical socket for connecting a first substrate which has engaging areas to a second substrate, comprising:

an elongated housing of an elastic insulating material, mountable on the second substrate, the housing having a recess extending from proximate one end to proximate the other end thereof and is dimensioned to receive the first substrate therein and the first substrate to be rotated relative to the second substrate;

a plurality of contacts positioned in the recess for electrically and mechanically connecting the first substrate to the second substrate;

elastic means positioned on at each end of the housing, the elastic means having an engaging portion which being projected from the housing and engaging the engaging areas of the first substrate to hold the first substrate at a predetermined rotation position, and a spring portion which being provided in the recess and, with the engaging areas of the first substrate engaging the engaging portion, elastically pushing the first substrate in a direction in which their engagement is urged.

4. An electrical connector according to claim 3, in which the elastic means has a fixing portion for detachably fixing the elastic means to the housing.

5. The electrical socket according to claim 3, wherein the elastic means has a reinforcing portion at the engaging portion to reinforce the engaging portion.

6. The electrical socket according to claim 3, wherein the elastic means has a guiding portion for guiding the first substrate into the recess.

7. The electrical socket according to claim 3, wherein the elastic means has a mounting section for mounting the housing on the second substrate.

* * * * *